United States Patent [19]

Fukuhara et al.

[11] Patent Number: 4,824,345

[45] Date of Patent: Apr. 25, 1989

[54] SCROLL MEMBER FOR SCROLL TYPE FLUID DISPLACEMENT APPARATUS

[75] Inventors: Seiichi Fukuhara, Takasaki; Eiji Fukushima, Fujumi, both of Japan

[73] Assignee: Sanden Corporation, Gunma, Japan

[21] Appl. No.: 43,460

[22] Filed: Apr. 28, 1987

[30] Foreign Application Priority Data

Apr. 28, 1986 [JP] Japan ..... 61-98797
Apr. 28, 1986 [JP] Japan ..... 61-98798

[51] Int. Cl.[4] ..... F01C 1/04; F01C 21/08; B23P 15/10

[52] U.S. Cl. ..... 418/55; 418/178; 29/156.4 R

[58] Field of Search ..... 418/55, 178, 270; 29/156.4 R

[56] References Cited

U.S. PATENT DOCUMENTS 4,303,379 12/1981 Hiraga et al. ..... 418/55
4,304,535 12/1981 Terauchi ..... 418/55
4,403,494 9/1983 McCullough ..... 72/360
4,433,564 2/1984 Fukushima et al. ..... 72/146
4,436,465 3/1984 Fukushima et al. ..... 409/243
4,487,248 12/1984 Fukushima et al. ..... 164/131
4,666,380 5/1987 Hirano et al. ..... 418/55

FOREIGN PATENT DOCUMENTS 59-37289 2/1984 Japan ..... 418/55
60-222580 11/1985 Japan ..... 418/55

OTHER PUBLICATIONS

Technical Memorandum–"Mass Production Manufacturing Techniques For Scroll Components", Jan, 1979.

*Primary Examiner*—John J. Vrablik
*Attorney, Agent, or Firm*—Banner, Birch, McKie & Beckett

[57] ABSTRACT

A scroll type fluid displacement apparatus is disclosed in which a pair of scrolls interfit at an angular and radial offset, each scroll including a circular end plate and a spiral element. The outer wall surface of each spiral element, which extends from an outer terminal end of the spiral element to the point of contact with the outer terminal end of the opposed spiral element at the orbital position where the sealed off fluid pockets are initially formed, is a rough unfinished surface. Accordingly, the time for manufacturing each spiral element is reduced and waste of material which is produced when the scroll surfaces are finished by turning is decreased.

12 Claims, 4 Drawing Sheets

FIG. 5
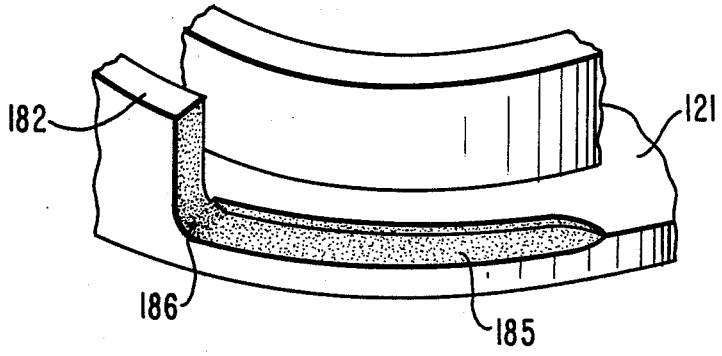
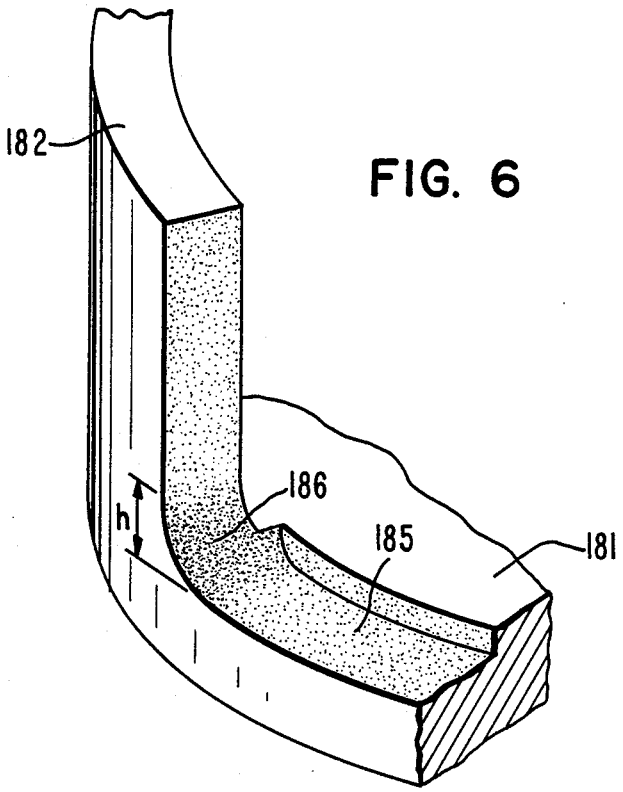
FIG. 6

SCROLL MEMBER FOR SCROLL TYPE FLUID DISPLACEMENT APPARATUS

TECHNICAL FIELD

The present invention relates to a scroll type fluid displacement apparatus, and more particularly, to the outer configuration of the scroll member for the scroll type fluid displacement apparatus.

BACKGROUND OF THE INVENTION

Scroll type fluid displacement apparatus are well known in the prior art. For example, U.S. Pat. No. 4,494,914 discloses a fluid displacement apparatus which includes a pair of interfitting scroll members. Each scroll member has a circular end plate and a spiral element extends from one end surface of the end plate. These scroll members are maintained angularly and radially offset so that both spiral elements interfit and make a plurality of line contacts between their spiral curved surfaces to thereby seal off and define at least one pair of fluid pockets. The relative orbit motion of the scroll members shifts the line contacts along the spiral curved surfaces and, as a result, the volume of the fluid pocket changes. Since the volume of the fluid pockets increases or decreases according to the direction of the orbital motion, the scroll type displacement apparatus is applicable to compress, expand or pump fluids.

To achieve smoother operation of such scroll type displacement apparatus, the inner and outer wall surfaces of spiral element and the axial end surface of the end plate should be finished over their entire surfaces by a conventional turning process.

However, it takes a long time to finish by turning the entire surfaces of the scroll elements. Also, since the entire surface of the scrolls are finished by turning, a considerable amount of materials from the scrolls is wasted.

SUMMARY OF THE INVENTION

It is primary object of this invention to provide scrolls for a scroll type fluid displacement apparatus which can be manufactured in less time.

It is another object of this invention to provide scrolls for a scroll type fluid displacement apparatus which can be manufactured at low cost.

A scroll type fluid displacement apparatus according to this invention includes a pair of scrolls each comprising a circular end plate and a spiral element extending from one side of the circular end plate. The outer wall surface of at least one of the spiral elements has a rough unfinished surface extending from the outer end of the one of the spiral elements to the point of contact with the outer end of the other one of the spiral elements at the orbital position where the fluid pockets are initially formed.

In a preferred embodiment, the outer surface of the circular end plate adjacent to and radially outward of the rough and unfinished surface of the spiral element is also rough and unfinished. Also in a preferred embodiment, at least one of the circular end plates includes a step like low portion at an outer peripheral edge portion. The low portion extends from an outer terminal end of the spiral element and includes an inner wall portion defined by an extension of the involute curve line defining the inner wall surface of the spiral element from which the low portion extends.

Further objects, features and other aspects of this invention will be understood from the detailed description of the preferred embodiment of this invention referring to the annexed drawings.

Figure 3:
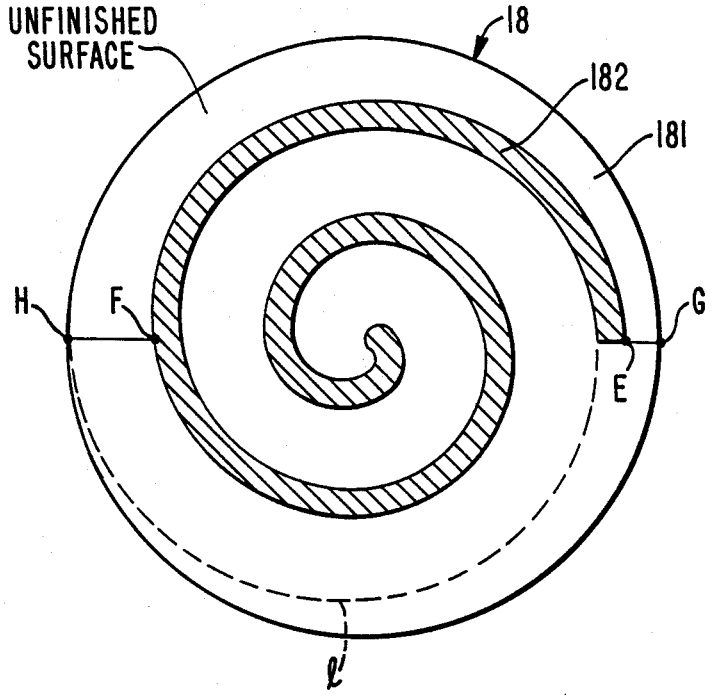
Figure 4:
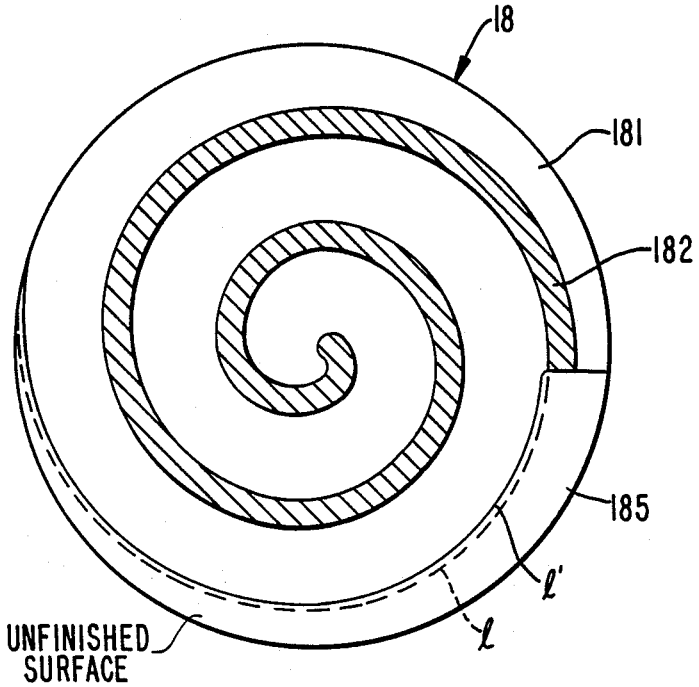

FIGS. *2a–2d* are schematic views illustrating the relative movement of interfitting spiral elements to compress the fluid between the scroll members;

FIG. 3 is a front view of a scroll member in accordance with one embodiment of this invention;

FIG. 4 is a front view of a scroll member in accordance with another embodiment of this invention;

FIG. 5 is a perspective view of a pair of the scroll in FIG. 4; and

FIG. 6 is an enlarged perspective view of a portion of FIG. 5.

DETAILED DESCRIPTION

Figure 1:
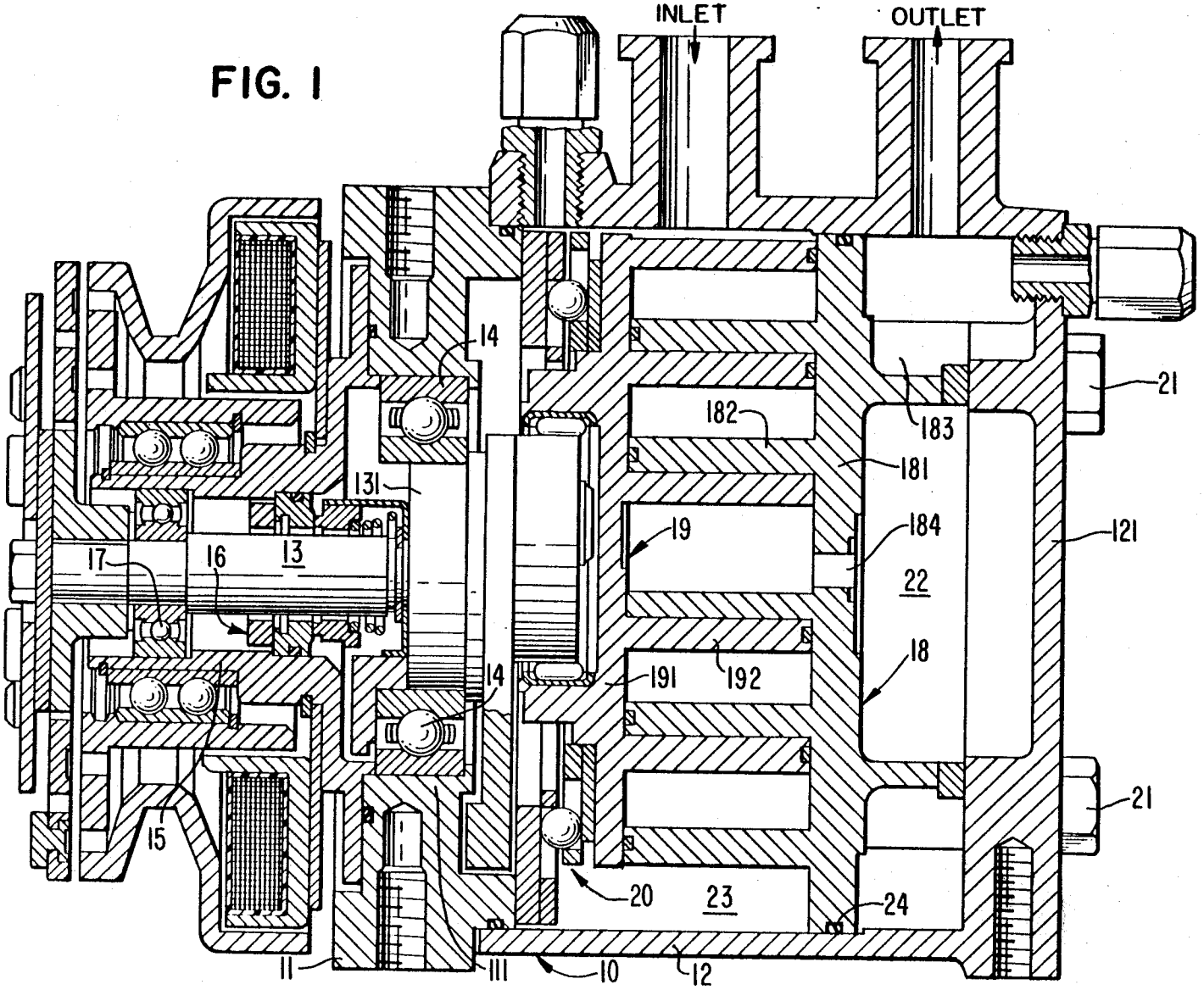
FIG. 1 is a cross-sectional view of a scroll type compressor with a scroll member in accordance with one embodiment of this invention.
Figure 2A:
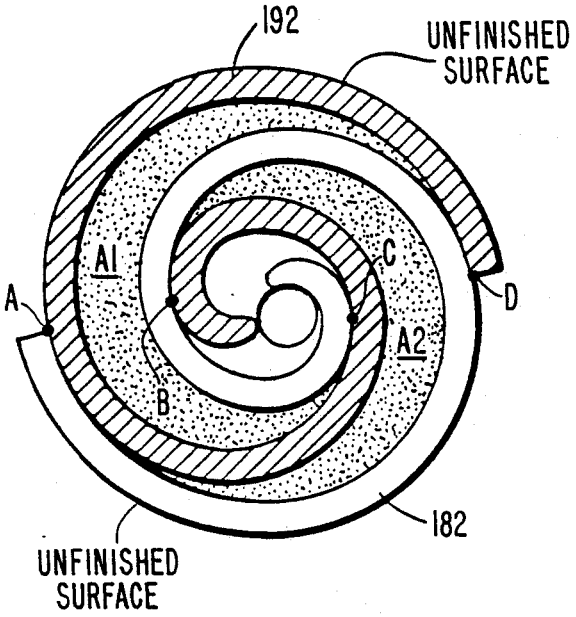
Figure 2B:
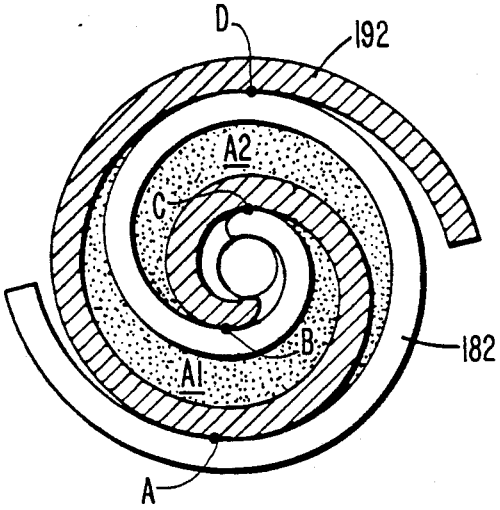
Figure 2C:
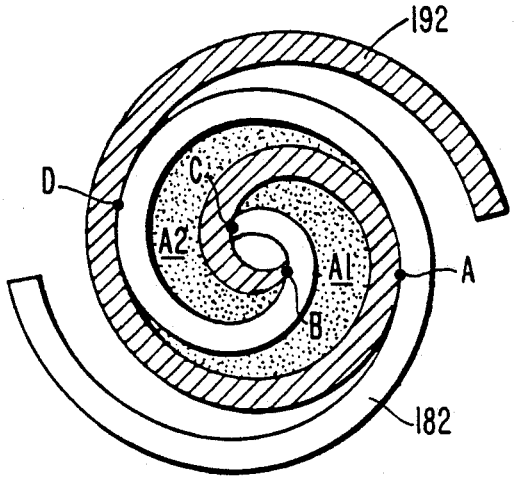
Figure 2D:
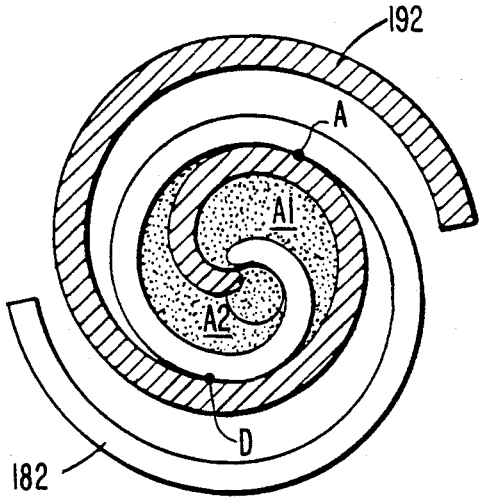

Referring to FIG. 1, a scroll type fluid displacement apparatus in accordance with this invention is shown. The illustrated apparatus is designed to operate as a scroll type compressor. The compressor includes compressor housing 10 having a front end plate 11 and cup-shaped casing 12 which is attached to an end surface of front end plate 11. An opening 111 is formed in the center of front end plate 11 for penetration or passage of drive shaft 13. Cup-shaped casing 12 is fixed on the inside surface of front end plate 11 by fastening devices, for example bolts and nuts (not shown), so that the open of cup-shaped casing 12 is covered by front end plate 11.

Front end plate 11 has an annular sleeve 15 projecting from the front end surface thereof. Sleeve 15 surrounds drive shaft 13 to define a shaft seal cavity. A shaft seal assembly 16 is assembled on drive shaft 13 within the shaft seal cavity. Drive shaft 13 is formed with a disk-shaped rotor 131 at its inner end portion. Disk-shaped rotor 131 is rotatably supported by front end portion 11 through a bearing 14 located within opening 111 of front end plate 11. Drive shaft 13 is also rotatably supported by sleeve 15 through a bearing 17.

The outer end of drive shaft 13 which extends from sleeve 15 is connected to a rotation transmitting device, for example, an electromagnetic clutch which may be disposed on the outer peripheral surface of sleeve 15 for transmitting rotary movement to drive shaft 13. Thus, drive shaft 13 is driven by an external power source, for example, the engine of a vehicle, through the rotating transmitting device.

A number of elements are located within the inner chamber of cup-shaped casing 12 including a fixed scroll 18, an orbiting scroll 19, a driving mechanism for orbiting scroll 19 and a rotation preventing/thrust bearing device 20 for orbiting scroll 19, formed between the inner wall of cup-shaped casing 12 and the rear end surface of front end plate 11.

Fixed scroll 18 includes circular end plate 181, spiral element 182 affixed to and extending from one end surface of circular end plate 181, and a plurality of internally threaded bosses 183 axially projecting from the outer end surface of circular end plate 181. The axial end surface of each boss 183 is seated on the inner surface of an end plate 121 of cup-shaped casing 12 and fixed by bolts 21. Fixed scroll 18 is thus secured within cup-shaped casing 12. Circular end plate 181 partitions the inner chamber of cup-shaped casing 12 into two chambers: a discharge chamber 22 and a suction chamber 23. A seal ring 24 is located between the outer peripheral surface of end plate 181 and the inner wall of cup-shaped casing 12 to seal off and define the two chambers. A hole of discharge port 184 which interconnects the center portions of the scrolls with discharge chamber 22 is formed through circular end plate 181.

Orbiting scroll 19 also includes a circular end plate 191 and a spiral element 192 affixed to and extending from one side surface of circular end plate 191. Spiral element 192 of orbiting scroll 19 and spiral element 182 of fixed scroll 18 interfit at an angular offset of 180° and predetermined radial offset. At least a pair of sealed off fluid pockets are thereby defined between both spiral elements 182,192.

The spiral element and the circular end plate of each scroll is integrally formed by casting to thus form a single piece scroll. The initially formed scroll is thereafter finished by turning to obtain the accurate surfaces to secure the sealing points between interfitting scrolls. Orbiting scroll 19, which is connected to the driving mechanism and to the rotation preventing/thrust bearing device 20, is driven in an orbital motion at a circular radius by rotation of drive shaft 13 to thereby compress fluid passing through the compressor unit, according to the general principles described above. Referring to FIG. 2, the compression cycle of fluid in one pair of fluid pockets will be described. FIG. 2 shows the relationship of fluid pressure in the fluid pocket to crank angle, and shows that one compression cycle is completed in this case at a crank angle of 360°.

Two spiral elements 182, 192 are angularly offset and interfit with one another. A shown in FIG. *2a*, the orbiting spiral element 192 and fixed spiral element 182 make four line contacts A–D. A pair of fluid pockets A1, A2 are defined between line contacts D–C and line contacts A–B, as shown by the dotted regions. The fluid pockets A1, A2 are defined not only by the wall of spiral elements 182, 192 but also by the end plates. Orbitting spiral element 192 orbits so that the center of orbiting spiral element 192 revolves around the center of fixed spiral element 182, while the rotation of orbiting spiral element 192 is prevented. This orbiting motion causes the pair of fluid pockets A1, A2 to shift angularly and radially towards the center of the interfitted spiral elements with the volume of each fluid pocket A1, A2 being gradually reduced, as shown in FIGS. *2a–2d*. Therefore, the fluid in each pocket is compressed.

As clearly shown in FIGS. *2a–2d*, a portion of the outer wall surface of each spiral element does not function to define the fluid pockets or compress the fluid. This area of the outer wall surface of both spiral elements 182, 192, which does not contribute to the compression cycle is in the range from outer terminal end of each respective spiral element to the point the outer walls contact the inner wall of the outer terminal end of the opposed spiral element to form the initial sealed off fluid pockets. FIG. *2a* illustrates this area on the outer walls of scrolls 182, 192 between points A and D.

Therefore, the outer wall surfaces of each spiral element 182, 192, which extend from the outer terminal end of the spiral element to the point where the outer wall surface contacts the inner wall surface of the outer terminal end of opposed spiral element at the orbital position (shown in FIG. *2a*) where sealed off fluid pockets are initially formed are generally rough, unfinished cast surfaces that have not been finished by turning. Also, the end surface of circular end plates 181, 191 which are located adjacent and radially outward of the unfinished walls are also preferably unfinished. The unfinished area of the end surface of circular end plate 181 is defined by points EFG and H in FIG. 3.

Referring to FIGS. 4 and 5, fixed scroll 18 is accordance with another embodiment of this invention is shown. Circular end plate 181 of fixed scroll 18 is provided with steplike low portion 185 at its outer peripheral edge portion. Low portion 185 extends along the over 180° from the outer terminal end of spiral element 182. Low portion 185 of end plate 181 is formed on the outer side of an imaginary line l which is an extension of the involute curve defining the inner wall surface of spiral element 182. The inner wall surface line l of low portion 185 may be shifted inwardly to an involute curve line l', since the inner wall surface and the axial end of the opposing spiral element will still secure effective compression of the apparatus. That is the axial tip of the opposing spiral element will still have sufficient end plate surface against which to form a seal even if line l is shifted slightly inward to l'. Low portion 185 is initially formed by casting so that the height of low portion 185 is less than the remaining end surface of circular end plate 181 which is finished by turning while low portion 185 remains unfinished. Orbiting scroll 19 can also be formed with a similar unfinished low portion. An alternative to forming low portion 185 would be to simply leave the area outward of line l or l'unfinished on a flat end plate, as shown in FIG. 3.

Referring to FIG. 6, an enlarged view illustrating the outer end portion of spiral element 182 is shown. As arc-shaped slant surface 186 is formed between spiral element 182 and circular end plate 181 to reinforce the base of spiral element 182. Arc-shaped slant surface 186 is defined by axial height h from the surface of low portion 185. Axial height h can be small a nd is sufficient to prevent breakage of spiral element 182. Arc-shaped slant surface 186 is formed by casting, and is not finished by turning.

This invention has been described in detail in connection with preferred embodiments, but these embodiments are merely for example only and this invention is not restricted thereto. For example, any combination of the unfinished surfaces shown in FIGS. 2, 3 and 4 could be combined. It will be easily understood by those skilled in the art that other variations can be easily made within the scope of the invention, as defined by the appended claims.

We claim:

1. In a scroll type fluid displacement apparatus including a housing, a pair of scroll members, one of said scroll members being fixedly disposed relative to said housing and having an end plate from which a first spiral element extends into the interior of said housing and the other scroll member movably disposed for nonrotative orbital movement within the interior of said housing and having an end plate from which a second spiral element extends, said first and second spiral elements interfitting at an angular and radial offset to make a plurality of line contacts to define at least one pair of sealed off fluid pockets, and drive means operatively connected to said outer scroll member to effect the orbital motion of said other scroll member and said line contacts whereby said fluid pockets move inwardly and change in volume, the two innermost fluid pockets eventually merging into a single pocket near the center of said spiral elements, the improvement wherein said scroll members include smooth finished outer surfaces in a first area for securing sealing of said fluid pockets and rougher unfinished outer surfaces in a second area, said second area being located along the outer surface of at least one of said first and second spiral elements and extending from an outer terminal end of said one of said spiral elements to the point of contact with the outer terminal end of said opposed spiral element at the orbital position where sealed off fluid pockets are initially formed.

2. The scroll type fluid displacement apparatus of claim 1 wherein outer surface of said circular end plate adjacent to and radially outward of said second area is rough and unfinished.

3. The scroll type fluid displacement apparatus of claim 1 wherein each of said scroll members is formed as a single integral cast metal member.

4. In a scroll type fluid displacement apparatus including a housing, a pair of scroll members, one of said scroll members being fixed disposed relative to said housing and having an end plate from which a first spiral element extends into the interior of said housing and the other scroll member movably disposed for non-rotative orbital movement within the interior of said housing and having an end plate from which a second spiral element extends, said first and second spiral elements interfitting at an angular and radial offset to make a plurality of line contacts to define at least one pair of sealed off fluid pockets, and drive means operatively connected to said other scroll member to effect the orbital motion of said other scroll member and said line contacts whereby said fluid pockets move inwardly and change in volume, the two innermost fluid pockets eventually merging into a single pocket near the center of said spiral elements, the improvement wherein at least one of said end plates of said scroll members includes steplike low portion at an outer peripheral edge portion thereof, said low portion having an unfinished outer surface and a radially inner wall, and said low portion extending from an outer terminal end of said spiral element connected to said one of said circular end plates, along said radially inner wall and radially outward of said radially inner wall, said radially inner wall being defined generally by an extension of the involute curve line defining the inner wall surface of said spiral element form which said low portion extends, said low portion being formed in a portion of the material of said last-mentioned end plate extending radially outward of said extension of the involute curve line.

5. The scroll type fluid displacement apparatus of claim 4 wherein each of said scroll members is formed as a single integral cast metal member.

6. The scroll-type fluid displacement apparatus of claim 2 wherein said radially inner wall is defined by a line spaced slightly radially inward of an extension of the involute curve line defining the inner wall surface of said spiral element from which said low portion extends.

7. In a scroll type fluid displacement apparatus including a housing, a pair of scroll members, one of said scroll members being fixedly disposed relative to said housing and having an end plate from which a first spiral element extends into the interior of said housing and the other scroll member movably disposed for non-rotative orbital movement within the interior of said housing and having an end plate from which a second spiral element extends, said first and second spiral elements interfitting at an angular and radial offset to make a plurality of line contacts to define at least one pair of sealed off fluid pockets, and drive means operatively connected to said other scroll member to effect the orbital motion of said other scroll member and said line contacts whereby said fluid pockets move inwardly and change in volume, the two innermost fluid pockets eventually merging into a single pocket near the center of said spiral elements, the improvement wherein at least one of said end plates of said scroll members includes a steplike low portion at an outer peripheral edge portion thereof, an arc-shaped portion being formed between said last-mentioned spiral element and said low portion, said low portion having an unfinished outer surface and a radially inner wall, and said low portion extending from an outer terminal end of said spiral element connected to said one of said circular end plates, along said radially inner wall and radially outward of said radially inner wall, said radially inner wall being defined generally by an extension of the involute curve line defining the inner wall surface of said spiral element from which said low portion extends.

8. In a scroll-type fluid displacement apparatus including a housing, a pair of scroll members, one of said scroll members being fixedly disposed relative to said housing and having an end plate from which a first spiral element extends into the interior of said housing and the other scroll member movably disposed for non-rotative orbital movement within the interior of said housing and having an end plate from which a second spiral element extends, said first and second spiral elements interfitting at an angular and radial offset to make a plurality of line contacts to define at least one pair of sealed off fluid pockets, and drive means operatively connected to said other scroll member to effect the orbital motion of said other scroll member and said line contacts whereby said fluid pockets move inwardly and change in volume, the two innermost fluid pockets eventually merging into a single pocket near the center of said spiral elements, the improvement wherein said scroll members include smooth finished outer surfaces in a first area for securing sealing of said fluid pockets, and rougher, unfinished outer surfaces in a second area, and said second area being located along the outer surface of at least one of said first and second spiral elements and extending from an outer terminal end of said one of said spiral elements to the point of contact wit the outer terminal end of said opposed spiral element at the orbital position where sealed off fluid pockets are initially formed, and at least one of said end plates of said scroll members includes a steplike low portion at an outer peripheral edge portion thereof, said low portion having an unfinished outer surface and a radially inner wall, and said low portion extending from an outer terminal end of said spiral element connected to said one of said end plates, along said radially inner wall and radially outward of said radially inner wall, said radially inner wall being defined generally by an extension of the involute curve line defining the inner wall surface of said spiral element from which said low portion extends.

9. The scroll type fluid displacement apparatus of claim 8 wherein an arc-shaped portion is formed between said last-mentioned spiral element and said low portion.

10. The scroll type fluid displacement apparatus of claim 8 wherein the outer surface of said circular end plate adjacent to and radially outward of said second area is rough and unfinished.

11. The scroll type fluid displacement apparatus of claim 8 wherein each of said scroll members is formed as a single integral cast metal member.

12. The scroll-type fluid displacement apparatus of claim 4 wherein said radially inner wall is defined by a line spaced slightly radially inward of an extension of the involute curve line defining the inner wall surface of said spiral element from which said low portion extends.

* * * * *